US006048195A

United States Patent [19]

Shimek et al.

[11] Patent Number: 6,048,195

[45] **Date of Patent: *Apr. 11, 2000**

[54] HOLLOW CERAMIC FIBER BURNER-LOG ELEMENT

[75] Inventors: Ronald John Shimek, Prior Lake; Daniel Curtis Shimek, Apple Valley; David Charles Lyons, Red Wing, all of Minn.

[73] Assignee: Heat-N-Glo Fireplace Products Inc., Lakeville, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/705,845

[22] Filed: Sep. 27, 1996

[51] Int. Cl.[7] ..... F23M 5/00; F24C 3/00

[52] U.S. Cl. ..... 431/125; 126/512; 126/92 AC; 431/354; 431/326

[58] Field of Search ..... 126/500, 512, 126/92 AC, 92 R; 431/354, 125, 126, 326

[56] References Cited

U.S. PATENT DOCUMENTS

| | | | |
|---|---|---|---|
| 258,922 | 6/1882 | Holland | 125/512 |
| 263,255 | 6/1882 | Verity | 126/512 |
| 464,457 | 12/1891 | Goetz et al. | 126/92 R |
| 663,811 | 12/1900 | Dudgeon | 126/92 R |
| 948,561 | 2/1910 | Hansen | 431/125 |
| 1,286,108 | 11/1918 | Richaards . | |
| 1,630,109 | 5/1927 | Chandler | 126/92 R |
| 2,084,566 | 6/1937 | Warfield | 126/92 R |
| 4,194,489 | 3/1980 | Swain | 126/512 |
| 4,828,485 | 5/1989 | Jankowski | 126/512 |
| 5,069,200 | 12/1991 | Thow et al. | 126/512 |
| 5,092,313 | 3/1992 | Blackburn et al. | 126/512 |
| 5,328,356 | 7/1994 | Hawkinson | 126/512 |
| 5,655,513 | 8/1997 | Whitfield | 126/512 |
| 5,688,568 | 11/1997 | Wolf et al. | 431/125 |
| 5,941,237 | 8/1999 | Shimek et al. | 126/512 |

FOREIGN PATENT DOCUMENTS

| | | | |
|---|---|---|---|
| 2010472 | 6/1979 | United Kingdom | 126/512 |
| 2032096 | 4/1980 | United Kingdom | 431/126 |
| 2068106 | 8/1981 | United Kingdom | 126/512 |
| 2156507 | 10/1985 | United Kingdom | 126/512 |
| 2182431 | 5/1987 | United Kingdom | 126/512 |

OTHER PUBLICATIONS

Reference Book of Inorganic Chemistry, Latimer and Hildebrand, Third Edition, the Macmillin Company, pp. 326–327.

Mark's Standard Handbook for Mechanical Engineers, Ninth Edition, McGraw–Hill, pp. 6–176–177,6–185,7–64.

Carborundum, Fiberfrax Durablanket–SE, Product Specifications, Two Pages, 1993.

*Primary Examiner*—Carl D. Price
*Attorney, Agent, or Firm*—John B. Sowell-Attorney

[57] ABSTRACT

A combined log set and gas burner system comprises a plurality of reinforced ceramic fiber burner elements formed in the shape of artificial logs and or glowing embers or a non-porous bed of coals. The burner elements are formed with a gas passageway in the interior of the element and a plurality of gas jets are made which connect the surface of the burner elements to the gas passageway in the burner elements. A source gaseous fluid is connected to the passageways to complete the combination burner system which eliminates the need for a separate burner apart from the log system.

19 Claims, 4 Drawing Sheets

HOLLOW CERAMIC FIBER BURNER-LOG ELEMENT

BACKGROUND OF THE INVENTION

1. Related Applications

The present invention employs a molded-mixture of refractory ceramic fibers and a binder of the type described in our co-pending U.S. application Ser. No. 08/588,866 filed Jan. 19, 1996 for a UNIVERSAL NON-POROUS FIBER REINFORCED COMBUSTION CHAMBER.

2. Field of the Invention

The present invention relates to artificial log elements of the type used in gas fireplaces. More particularly, the invention relates to artificial log elements which also serve as high efficiency gas burners.

3. Description of the Prior Art

Artificial logs are known and are generally classified in U.S. Class 264. Such logs are usually made by the same process as that described in our co-pending U.S. application Ser. No. 08/588,866 referenced above and incorporated by reference herein.

Heretofore, artificial ceramic logs were made by molding processes that resulted in solid cross-section log elements.

Our co-pending U.S. application Ser. No. 08/588,866 shows a U-shaped ceramic pan attached to the floor of a ceramic combustion chamber in a manner which forms a hollow burner element but does not form a portion of the prior art.

It would be desirable to provide gas log elements and glowing ember elements which would eliminate the need for convention burner elements and also provide high efficiency burning of gaseous fuels.

SUMMARY OF THE INVENTION

It is a principal object of the present invention to provide an artificial burner-log element employing a non-porous to gas ceramic fiber mixture.

It is another primary object of the present invention to provide hollow burner-log elements with burner jets located at pre-determined places in areas on the elements to provide an assortment of different length flames and glow effects.

It is another primary object of the present invention to incorporate a gas burner into a gas log element, thus, eliminating conventional metal gas burners.

It is another object of the present invention to provide a burner-log set that eliminates burner flames which impinge on the other elements of the log set and produce undesirable carbon monoxide.

It is another object of the present invention to provide a low mass light weight and low cost burner-log set that can be assembled at the factory and shipped as a plug-in-ready-to-use log set.

According to these and other objects of the present invention there is provided a burner system comprising a plurality of reinforced ceramic fiber (RCF) burner elements formed in the shape of artificial logs and/or glowing embers or ashes. The burner elements are formed with a gas passageway in the interior of the element and a plurality of gas jets are made which connect the surface of the burner element to the gas passageways in the burner elements. A source of gaseous fuel is connected to the passageways to complete the novel log/burner system, preferably in the form of an air and gas mixture.

DETAILED DESCRIPTION OF THE PREFERRED EMBODIMENT

Figure 1:
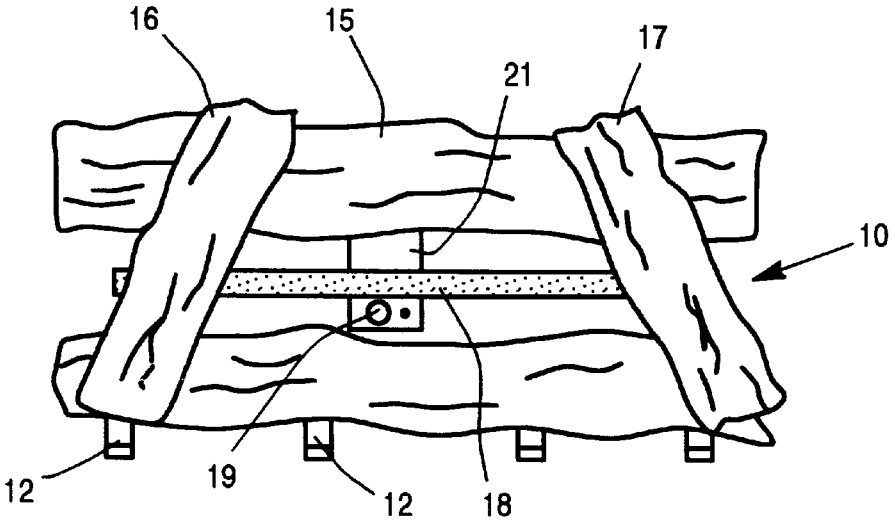
Figure 1 (Prior Art)
FIG. 1 is a plan view of a typical prior art gas log set having a burner placed between two transverse logs and under two cross logs.

Refer to FIG. 1 and showing a typical prior art gas log set 10 which is supported on a ceramic or metal grate 11 having a front fence 12 and support legs 13. The log set 10 comprises a front transverse log 14 and a rear transverse log 15 which form the support for first and second cross log 16 and 17. Below the log set 10 there is shown a burner 18 and a pilot light 19 which are connected by gas lines to a control box 21 by means of a gas inlet pipe 22 and a pipe that is unnumbered.

Figure 2:
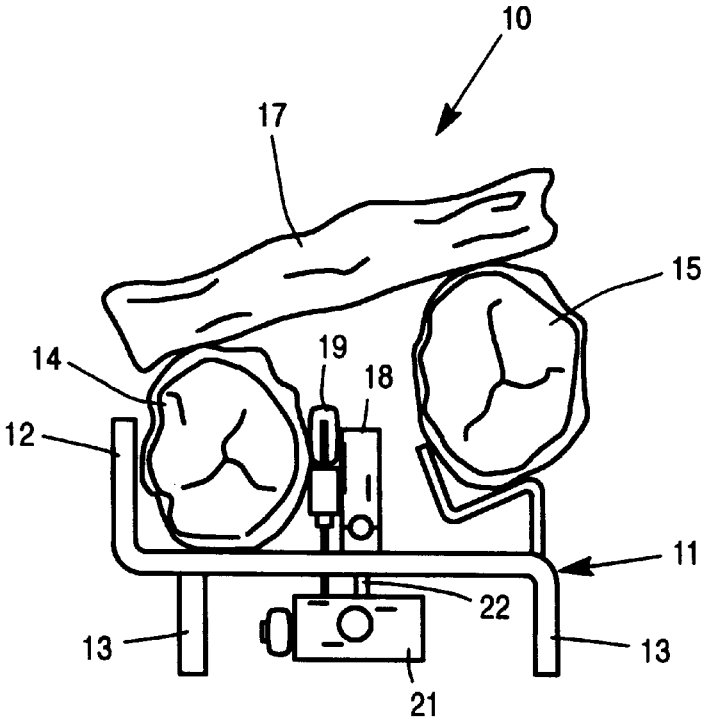
Figure 2 (Prior Art)
FIG. 2 is a an end view of the prior art log set shown in FIG. 1.

Refer now to FIG. 2 showing an end view of the prior art log set shown in FIG. 1. The numbers used in FIG. 2 are identical to those used in FIG. 1 and describe the same elements and do not require additional description herein.

Figure 3:
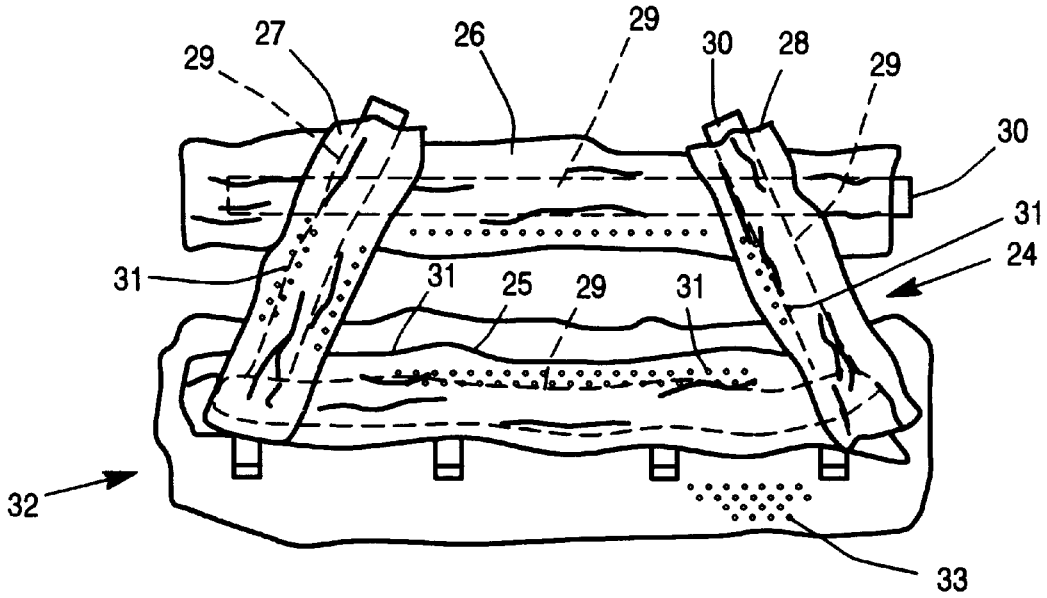
FIG. 3 is a plan view of the present invention gas log set which does not require a conventional gas burner under the log.

Refer now to FIG. 3 showing a plan view of the present invention log set 24 which comprises a front log burner 25, a rear log burner 26, a cross log burner 27, and cross log burner 28. Each of the aforementioned log burners are provided with a gas passageway 29 which may be formed in the process of making the log elements or may be drilled or machined in the log elements after curing. In any event a plug or cap 30 will be provided at the ends of one of the gas passageways to prevent the escape of gas.

A plurality of gas jets 31 are shown on the surface of the logs 25 through 28 which are employed for different size flames and/or connecting the gas flame and are called lighting jets. Below the log burner elements 25 through 28 there is provided a gas burner element in the form of a bed or mound of embers or glowing embers 32 which are provided with glow jet apertures 33.

Figure 4:
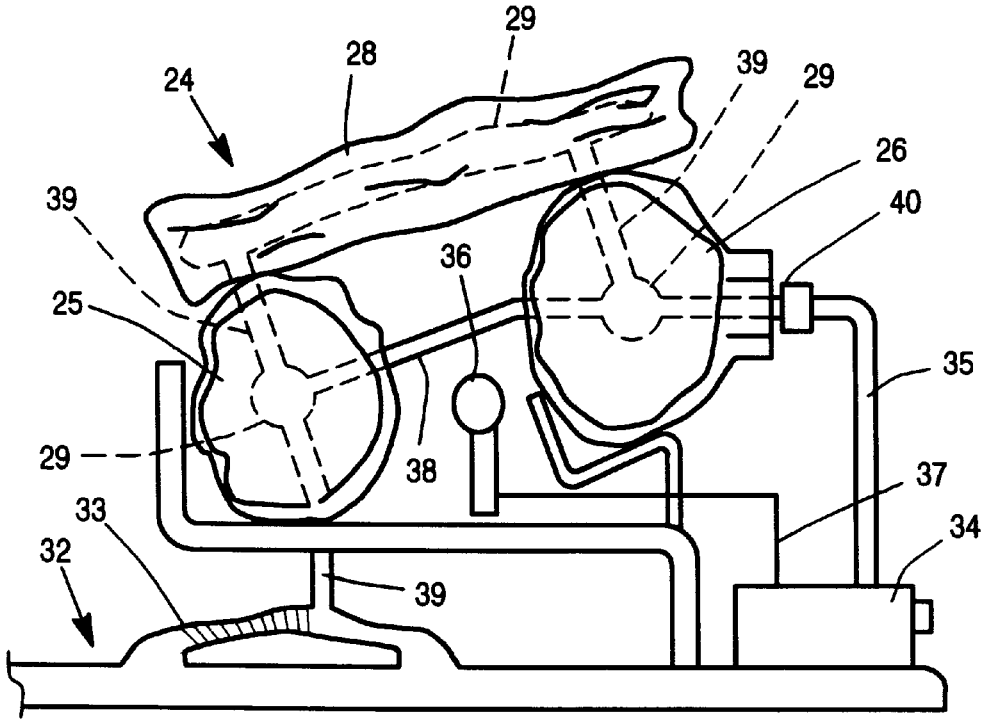
FIG. 4 is an end view of the gas log set shown in FIG. 3.

Refer now to FIG. 4 showing an end view of the gas log set 24 in FIG. 3. A control box 34 which connects to a source of gaseous fuel is shown having a gas inlet pipe 35 connected to the rear transverse log 26 which has a gas passageway 29 therein. The gas supply from line 35 is coupled to the log 26 by a mixing valve 40 connected to the back of the log. Gas in passageway 29 is conducted via a connector 39 to the passageway 29 in log 28 as well as log 27 (not shown). A second connector 39 from log 28 to log 25 connects to gas passageway 29 of log 25 which also serves as a supply for the lower connector 39 which connects to the element 32 shown as being below logs 25 and 26. The burner element 32 is shown having small jets which are termed glowing ember jets and do not emit long flames. The jets to be described that are provided in the log set will produce flames of different length depending on the size of the jets provided as will be described hereinafter. It is optional to supply a lighter tube 38 between the passageways 29 in the logs 25 and 26 in the vicinity of the pilot 36.

It will be understood that the gas pilot 36 connects to the control 34 via a gas line 37. However, this particular arrangement may be replaced with an electronic spark ignition system using a ground plate or spark plate on the rear of the logs 25 or 26 where the spark module would not be seen from the front. When the electronic spark ignition system is used, the pilot light may be eliminated.

It will be appreciated that the log set 24 may be totally assembled in a factory and shipped as a plug-in unit with or without the lower burner element 32. Since the logs are individually connected in a rigid manner, they will maintain their integrity and rigidity when shipped as a unit.

Figure 5:
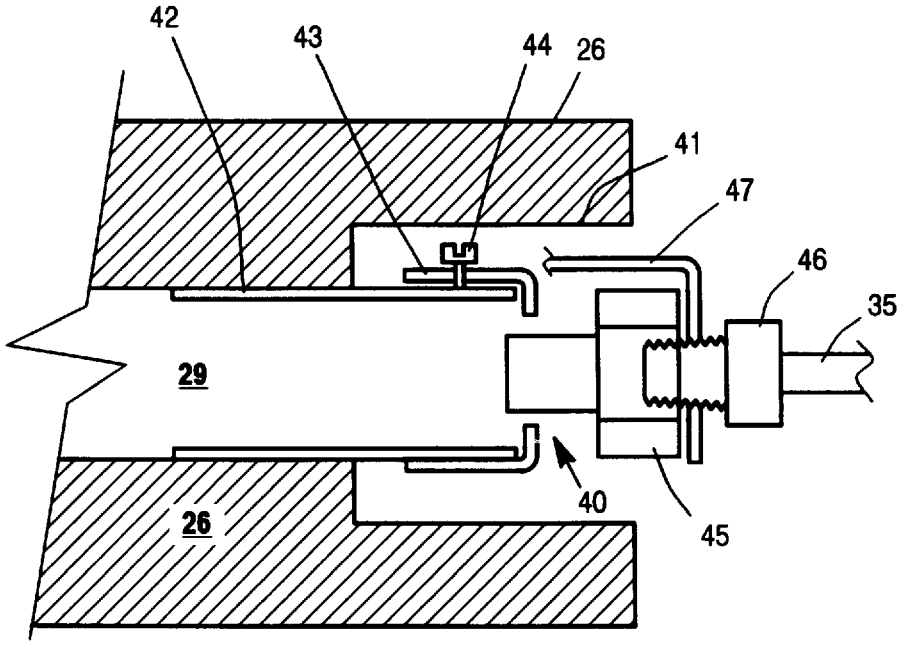
FIG. 5 is an enlarged detail of a hollow ceramic fiber burner element showing a gas mixing valve.

Refer now to FIG. 5 showing an enlarged detail of the end of any one of the hollow ceramic fiber burner elements. The element 26 is illustrated as having a recess 41 for receiving a gas connector piece 42 which may be a piece of aluminum tubing or other metal tubing which receives thereon an adjustable shutter 43 which is fixed in its desired shutter position by set screw 44. There is shown a gas orifice 45 extending into the opening of the shutter to form the mixing valve 40 system. The mixing valve 40 is supported by a bracket 47 which is held in place by the gas fitting screw adapter 46 which connects to the aforementioned gas supply line 35 that supplies gas to the passageway 29.

Figure 6:
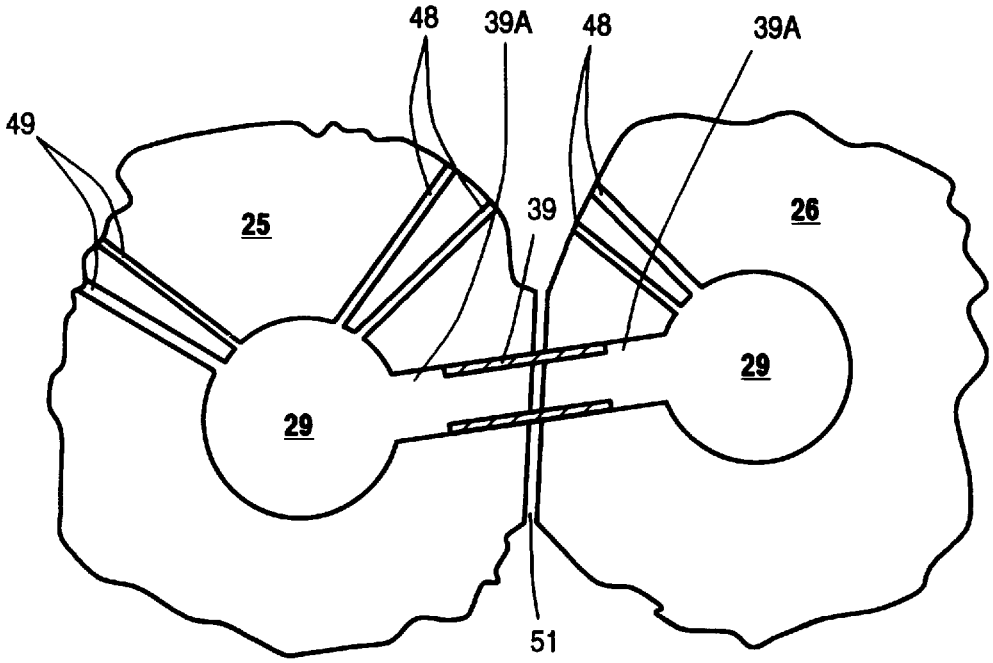
FIG. 6 is an enlarged detailed end section showing a cross connection between two log elements.

Refer now to FIG. 6 showing an enlarged detail of a cross connection between two of the log elements. For purposes of this illustration, a front log 25 and a rear log 26 are shown having a flat mating portion which is unnumbered. The front log 25 is provided with long flame jet apertures 48 which are directed toward log 26. Log 26 is provided with long flame jet apertures 48 which are directed at log 25 and the flames together will form a glowing ember surface on the two logs 25 and 26 at the areas opposite the long flames. There is shown two of a plurality of medium flame jet apertures 49 which cause decorative flames at the front of the log 25. Log 25 and log 26 may be connected by a log connector 39 which firmly holds the two logs together closing the gap 51. However, since the logs 25 and 26 are provided with flat portions at the log connector means 39,or passageway 39A, it is possible to connect the two logs by high temperature adhesives without the use of the log element connector 39 which is a preferred method of connecting the logs. If the logs are to be shipped, it is also preferred to add an adhesive to the log connector before inserting it in the passageways 39A.

Figure 7:
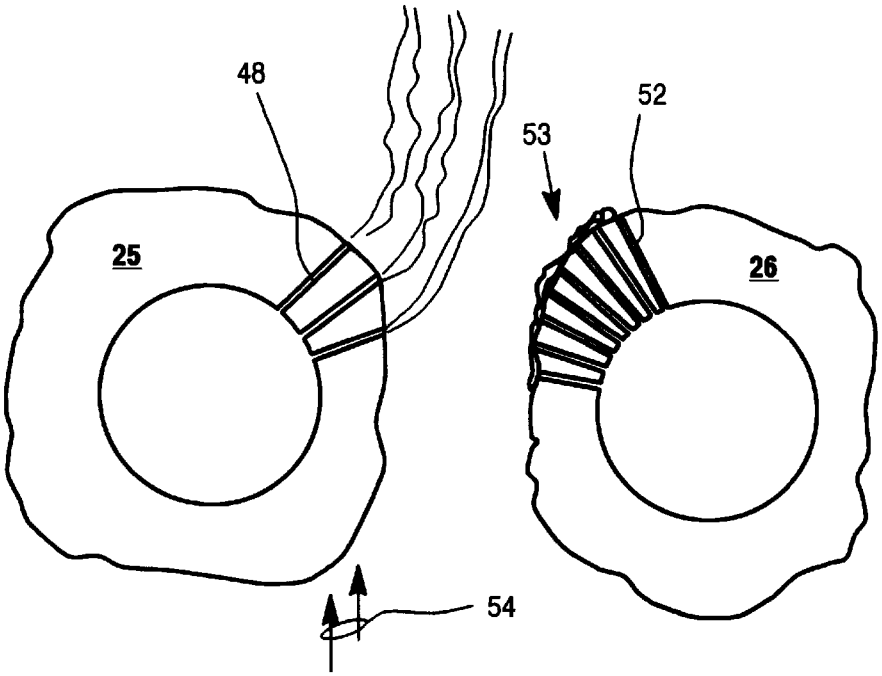
FIG. 7 is an enlarged detailed end section showing how gas flames are restricted to desired surfaces of the log element.

Refer now to FIG. 7 showing in enlarged detail how the gas flames may be restricted to the desired surfaces of the log elements. For purposes of this illustration, logs 25 and 26 are shown separated in the manner in which they are usually arranged in the prior art. The log 26 is shown having long flame jets 48 which create artificial flames that appear to originate from between the two logs 25 and 26. The log 26 is provided with smaller glow jets 52 which heat the surface of the log 26 at the desired surface so as to create a glow effect at area 53. To illustrate the efficiency of the present log system, there are shown flame direction arrows 54 which are indicative of where the gas flames of a prior art burner would impinge upon the log sets 25 and 26. When the flames impinge on a mass such as a log, the flame is cooled to the point where it does not have complete combustion and creates a residue of carbon monoxide. Not only does the flame and heat at point 54 waste heat, but the decorative effect, if any, cannot be seen from the front of the log set. It is a feature of the present invention to provide the flame jets where the flames are desired in the size in which they are desired without creating a waste of fuel or generating carbon monoxide. Thus, the novel log set is indeed a high efficiency burner.

Figure 8:
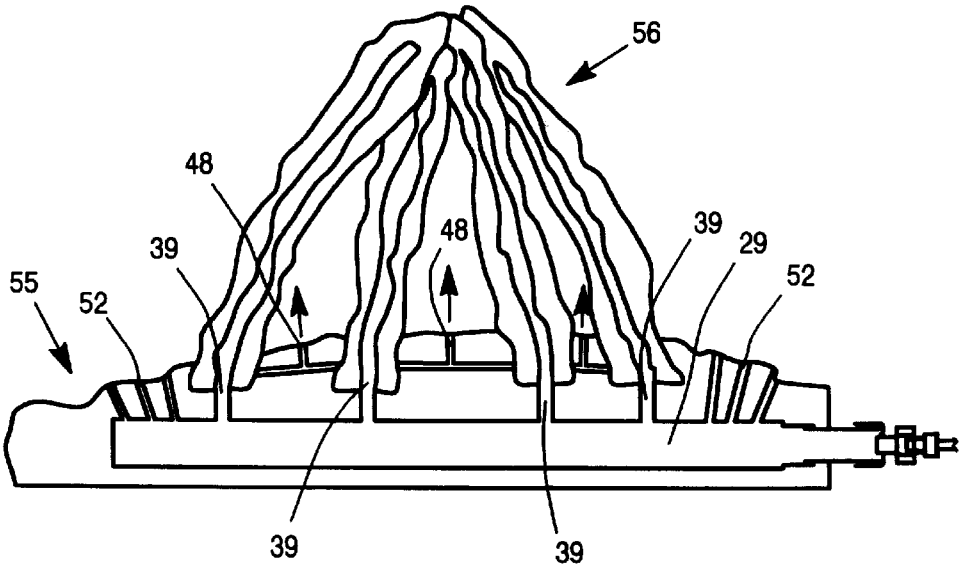
FIG. 8 is a schematic drawing and elevation showing a bed of coals log element in the form of glowing embers having a base burner also supplying a tapered stack of logs in a shape of a campfire.

Refer now to FIG. 8 showing a schematic drawing in elevation of a glowing ember base 55 which is provided with a gas passageway 29. The glowing ember base is also provided with a plurality of glow jets 52 which may be around the base forming an annular ring for the tapered stack of logs 56 in the form or shape of a camp fire. In this arrangement, the base may be provided with an annular ring in which there are glow jets 52 which form glowing embers at the surface of the base 55 for supporting the campfire log set outside of a fireplace. The individual hollow logs 56 which form the camp fire shape are also provided with medium and long flame jets which are not shown. The individual logs are connected to the gas passageway 29 by means of log connectors 39 or log connector means as described hereinbefore. Long jets 48 may be connected through the center portion of the raised mound and connect into the gas passageway 29 as shown at gas jets 48. It will be understood that a mixing valve and connector 40 as previously described in FIG. 5 may be provided at any portion of the circular base or mound to supply a mixture of air gas fuel through the passageway 29.

It will be appreciated and understood that the logs 56 may be removed and a conventional log set 24 substituted above the glowing embers base 55 and achieve a high efficiency system. If the amount of heat to be generated is very low, the burner log set above the hollow glowing embers base 55 need not be any or all hollow burner log elements.

Having explained a preferred embodiment of the present invention and modifications thereof, it will now be appreciated that it is possible to make self supporting hollow ceramic log elements which are non-porous to gas but may be porous to water and aqueous solutions. However, it has been shown that these passageways and apertures form burner structures which will perform the same burner function as solid refractory or metal burners used before. Further, it is now possible to interchange the individual elements shown and described in any selective manner. In one large burner system, several mixing valves have been attached to a plurality of different logs to feed the multiple burner element system.

What is claimed is:

1. A high efficiency soot free gas burner system for a fireplace, comprising:

a. a log set of open porous lightweight reinforced ceramic fiber (RCF) log elements, b. said log set comprising at least one RCF log burner element, c. said log burner element being vacuum molded to form a hollow interior gas passage and an outer surface formed to resemble the shape of firewood, d. said hollow interior gas passage forming a gas passageway means having an interior surface which is non-porous to gas, e. burner jet means comprising a plurality of apertures connecting said outer surfaces of said log burner element with said interior non-porous surface of said hollow interior gas passageway means, f. said burner jet means comprising apertures on the visible surfaces of said burner elements for producing visible flames of different lengths, and g. air gas control means for connecting a supply of gas into said non-porous gas passageway means of said log burner element.

2. A high efficiency gas burner system as set forth in claim 1 which comprises a plurality of said reinforced ceramic fiber burner elements at least one of which includes a hollow log gas burner element coupled to said gas supply, and each said burner element having an air gas control means.

3. A high efficiency gas burner system as set forth in claim 2 wherein some said burner elements comprise a plurality of hollow log shaped elements each having gas passageway means in the hollow interior coupled to said gas supply for producing flames that do not impinge on other elements.

4. A high efficiency gas burner system as set forth in claim 2 which comprises a plurality of reinforced ceramic fiber burner elements at least two of which have their gas passageway means interconnected by short pipes for common supply by said gas supply.

5. A high efficiency gas burner system as set forth in claim 2 which further includes detachable connector means for connecting gas passageway means of burner elements.

6. A high efficiency gas burner system as set forth in claim 2 wherein said plurality of burner elements comprise a plurality of gas log elements and a bed of embers element each having non-porous gas passage way means in said hollow interior and burner jet means to provide said decorative gas flames of different lengths emanating from said outer surfaces.

7. A high efficiency gas burner system as set forth in claim 6 wherein a plurality of said burner elements have their gas passage means connected together and the combined elements comprise a shape in the form of a set of horizontal logs with glowing embers below the logs.

8. A high efficiency gas burner system as set forth in claim 6 wherein a plurality of said burner elements have their gas passage way means connected together and the combined elements comprise a vertically inclined tapered stack of logs interconnected to form a camp fire.

9. A high efficiency gas burner system as set forth in claim 8 wherein said log shaped burner elements are provided with burner jet means on their outer exposed surfaces of the tapered stack of log elements, and said bed of embers element is provided with a plurality of burner jet means directed to impinge on the exposed surface of said tapered stack of log elements that form a camp fire with flames both inside and outside the tapered stack of logs.

10. A high efficiency soot free gas burner system for a fireplace, comprising:

a set of interconnected substantially porous reinforced ceramic fiber logs having a low specific gravity interior and a low coefficient of thermal conductivity, a plurality of said individual logs in said set of logs having hollow gas containing passageways in the interior portion of the logs, connector means comprising individual pipes for connecting together said hollow gas passageways of adjacent log elements, burner jet means comprising a plurality of gas burner apertures connecting outer surfaces of said individual log elements with the hollow gas passageways in the logs, and said hollow gas containing passageways being formed from a slurry and a binder to provide interior surfaces that are and non-porous to gas.

11. A high efficiency gas burner system as set forth in claim 10 which further includes gas supply means connected to said burner system at one or more of said hollow gas passageways.

12. A high efficiency gas burner system as set forth in claim 11 wherein said gas supply means comprises a mixing valve connected in a recess of a hollow gas passageway for supplying a predetermined mixture of gas and air to said burner apertures via said hollow gas passageways.

13. A method of making a combined log set and gas burner system, comprising the steps of:

forming a plurality of individual porous reinforced ceramic fiber burner elements, forming hollow gas containing passageway means in a plurality said burner elements with non-porous gas containing surfaces, forming burner jets connecting said hollow gas passageway means to the outer surface of the hollow burner elements, mechanically connecting said gas passageways means of said individual burner elements together to form a log set burner and a second burner system under said log set burner, and connecting a gas supply adapter to at least one of said burner elements to form a combination log set and burner system.

14. A method as set forth in claim 13 wherein the step of connecting said burner elements comprises the step of connecting together all of the hollow gas passageway means.

15. A method as set forth in claim 13 wherein the step of forming individual ceramic fiber burner elements and the step of forming hollow gas passageway means are performed at the same time by vacuum molding.

16. A method as set forth in claim 15 wherein the steps of forming burner elements and forming hollow gas passage way means are performed by molding and forming.

17. A method as set forth in claim 13 which further incudes connecting said individual burner elements to a burner base element to form a camp fire log set.

18. A method as set forth in claim 13 wherein the step of forming burner jets comprises making plural apertures of different sizes to provide different size flames.

19. A method as set forth in claim 18 wherein the step of forming burner jets comprises curing the formed burner element prior to drilling or machining aperatures in the element.

* * * * *